US005161810A

United States Patent [19]

DeCesare

[11] Patent Number: 5,161,810

[45] Date of Patent: Nov. 10, 1992

[54] ICE SKATEBOARD WITH MEANS FOR IMPARTING A CANT TO THE BLADES

[76] Inventor: John J. DeCesare, 143 Ridgewood Ave., Glen Ridge, N.J. 07028

[21] Appl. No.: 680,844

[22] Filed: Apr. 5, 1991

[51] Int. Cl.[5] ..... A63C 17/18

[52] U.S. Cl. ..... 280/14.2; 280/15; 280/16; 280/22.1; 280/28

[58] Field of Search ..... 280/14.2, 845, 13, 14, 280/21.1, 22.1, 28, 841, 7.13, 7.14, 7.12, 15, 16

[56] References Cited

U.S. PATENT DOCUMENTS

| | | | |
|---|---|---|---|
| 1,418,829 | 6/1922 | Riedler | 280/14 |
| 3,109,665 | 11/1963 | Remmen | 280/16 |
| 3,329,439 | 7/1967 | Gebien | 280/16 |
| 4,043,565 | 8/1977 | Mogannam | 280/7.13 |
| 4,114,913 | 9/1978 | Newell et al. | 280/7.14 |
| 4,521,029 | 6/1985 | Mayes | 280/7.14 |
| 4,896,893 | 1/1990 | Shumays et al. | 280/7.14 |

FOREIGN PATENT DOCUMENTS

| | | | |
|---|---|---|---|
| 259383 | 1/1968 | Austria | 280/845 |
| 629966 | 5/1982 | Switzerland | 280/14.2 |
| 852696 | 8/1981 | U.S.S.R. | 280/28 |

*Primary Examiner*—Eric D. Culbreth
*Attorney, Agent, or Firm*—Howard E. Thompson, Jr.

[57] ABSTRACT

An ice skateboard comprising an elongated platform having secured to the front and rear portions of the underside conventional skateboard trucks, with transverse axles supported by a structure facilitating slight controllable swinging movement of the axle in response to the shifting of weight on the platform, wherein each of the front and rear axles rotatably supports at opposed ends thereof elongated skate blade mounting units in a manner to be parallel to the center line of the platform, and each of the mounting units bearing a skate blade protruding in a direction away from the platform, the exposed edge of each blade having a front to rear contour of slightly convex curvature and a transverse contour of markedly concave curvature providing closely spaced ice gripping edges, and the mounting units for said blades being so fashioned as to provide a cant to the blades of at least 5°, thereby convergently orientating the mounted blades. The cant can be either fixed or variable, with variations being provided by an insert in the mounting unit facilitating its rotation on a front to rear axis, and an adjustable linkage connecting an upwardly protruding member on the mounting unit with a portion of the truck structure. When such adjustable linkage is aligned with the truck axis adjusted cant remains constant during use, whereas if such linkage is disposed angularly with respect to the truck axis the preset cant will be varied by the shifting of weight on the platform.

10 Claims, 4 Drawing Sheets

ICE SKATEBOARD WITH MEANS FOR IMPARTING A CANT TO THE BLADES

This invention relates to improved ice skateboards wherein use and performance on ice is enhanced by incorporating means for imparting a cant to the skate blades.

BACKGROUND OF THE INVENTION

For a number of years there has been increasing use and popularity of skateboards incorporating wheels mounted at opposite ends of transverse truck mechanisms secured to forward and rear end portions of an elongated foot engaging platform. The truck mechanisms have transverse axle portions with anularly disposed projections for securing the same to a mounting plate.

One of such projections has a ball-socket engagement with the mounting plate, and the other projection is secured to a compression element on a spaced portion of the mounting plate, with the point of attachment to said compression element being spaced from the mounting plate substantially further than the ball-socket.

This means for securing the axle portion to the mounting plate permits limited movement of the axle portion about an axis which is angularly disposed with respect to the mounting plate and platform, providing movement which can be viewed as a combination of coplanar rotation and tilting of the axle portion with respect to the platform as weight is shifted from one side to the other of the platform. The extent of such combined rotational and tilting movement can be increased or decreased by respectively loosening or tightening said compression element.

By mounting the trucks in opposite directions with the ball-socket portions thereof toward the ends of the platform, weight changes on the platform cause the axle portions of the trucks to rotate in opposite directions to thereby permit steering of the skateboard in operation by shifting of the weight from side to side on the platform, with the skateboard turning in the direction of the side to which weight is applied.

In addition to this type of steering, the sensitivity of which can be varied by adjustment of the compression elements, quick steering or change of direction can be accomplished by momentarily raising one truck and its associated wheels; and this type of manipulation is frequently facilitated by providing upwardly inclined contour to the rear end of the skateboard platform.

With the growing popularity of roller skateboards, it is not surprising that others have attempted to adapt the skateboard principle to ice skateboards. A problem arises, however, in that the steering control above described, which works effectively for roller skateboards, does not appear to be as effective when ice blades are substituted for the conventional wheels.

A preliminary search has brought to light the following recently issued United States patents relating to ice skateboards:

| U.S. Pat. Nos. | | |
|---|---|---|
| Paul Mogannam | 4,043,565 | August 23, 1977 |
| William K. Newell | 4,114,913 | Sept. 19, 1978 |
| Thomas L. Mayes | 4,521,029 | June 4, 1985 |
| Adam A. Shumayes et al | 4,896,893 | January 30, 1990 |

None of these patents in any way suggest the improvement of the present invention, but two of the patents reflect awareness of the problem of attaining the desired steering control with ice blades.

U.S. Pat. No. 4,043,565 provides blades of generally triangular contour, with each edge ground in a concave fashion to provide better ice gripping to enhance steering control. As the pre-adjusted edges become worn through use, causing diminishing steering control, the triangular blades can be rotated to expose freshly ground edges to thereby, for a time, improve the steering control.

In U.S. Pat. No. 4,114,913 an effort is made to enhance steering control by specially contouring the ice engaging blade edge, as indicated for example, by the protruding V-shaped contour of the blade edge, as shown in FIG. 3 of the patent. This approach, while possibly effective with a freshly sharpened blade, would rapidly lose its effectiveness by wearing down of the ice engaging edge of the V-contour in use.

It would appear therefore that the efforts of others have failed to provide an ice skateboard which can afford the operator sustained steering control.

THE INVENTION

It has now been found, in accordance with the present invention, that greatly enhanced steering control can be provided in ice skateboards, by incorporating in the blade mountings, structurual features which impart a cant to the skate blades, which can be predetermined by the mounting structure, but preferably is of an adjustable and variable nature.

Regarded in certain of its broader aspects, the improved skateboard comprises an elongated platform having secured to the front and rear portions of the underside conventional skateboard trucks, with transverse axles supported by a structure facilitating slight controllable swinging movement of the axle in response to the shifting of weight on the platform, wherein each of the front and rear axles supports at opposed ends thereof elongated skate blade mounting units in a manner to be parallel to the center line of the platform, and each of the mounting units bearing a skate blade protruding in a direction away from the platform, the exposed edge of each blade having a front to rear contour of slightly convex curvature and a transverse contour of markedly concave curvature providing closely spaced ice gripping edges, and the mounting units for said blades being such as to provide a cant of the blade of at least 5°, thereby convergently orientating the mounted blades.

The cant can be either fixed or variable, with variation being provided by an insert in the mounting unit facilitating its rotation on a front to rear axis, and an adjustable linkage connecting an upwardly protruding member on the mounting unit with a portion of the truck structure. When such adjustable linkage is aligned with the truck axis an adjusted cant remains constant during use, whereas if such linkage is disposed angularly with respect to the truck axis the preset cant will be varied by the shifting of weight on the platform.

In all adaptations of the inventions the elongated skate blade mounting units have central transverse cylindrical passages which closely but rotatably engage the truck axle so that in use the mounting units have limited independent rotation in planes essentially perpendicular to the platform.

In adaptations of the invention providing a fixed or preset cant the angularity of the blade to the truck axis can be provided in various ways. If the mounting member is oriented perpendicularly to the truck axis the blade can be positioned at the desired angle as the mounting member is molded or otherwise fabricated.

As an alternate approach, the blade can be positioned parallel to the side walls of the mounting member and the axle receiving passage formed at a desired angle to the sides of the mounting member. In such event the areas of the side walls should be inwardly, and outwardly offset to provide bearing surfaces surrounding and perpendicular to the axle passage.

When it is desired to provide adjustable blade cant, it is essential for the blade mounting members to be rotatable on axes extending longitudinally thereof. This is accomplished by forming each mounting member with a cut-out in the upper central portion to receive a longitudinally oriented cylindrical member having a transverse passage to closely and rotatably engage the truck axle. The cylindrical member suitably has co-axial smaller diameter extensions to engage cylindrical bearing members interfitting with the mounting member cut-out, and clamped in position by contoured protrusions on a top plate detachably secured to the mounting member. This bearing support assures free rotary movement of the mounting member with respect to the axle supported cylindrical member.

For controlling this rotary movement the top plate is provided, in alignment with the truck axle, with an upwardly extending stud with an expansion of spherical curvature which forms one end of a double ball-joint adjustable linkage. The other end of the linkage is mounted, via a similar stud with spherically curved expansion, fixedly secured to a spaced portion of the truck structure. The linkage includes aligned, internally threaded tubular portions receiving a screw element having reverse threads at opposed ends and a central enlargement to facilitate rotation thereof. The internal threads preferably include plastic inserts to prevent unintended rotation of the screw element. Such ball-joint adjustable linkages of varied length, and with a variety of mounting studs are commercially available.

With the remote end of the adjustable linkages fixed to the truck it will be apparent that rotation of the screw element in one direction will rotate the blade mounting member clockwise, and in the other direction counterclockwise. Thus it becomes very easy to adjust the screw element to provide any desired tilting of the blade mounting member and cant of the blade supported therein.

If the end of the adjustable linkage is mounted on the axle housing of the truck so that the linkage is parallel to the axle, the cant adjustment of the blade made prior to use remains the same during use. Thus in performance the blades will behave in the same way as the earlier fixed cant adaptations. The difference is that the user is able to adjust the amount of cant prior to use to better adjust the ice skateboard to differing ice conditions.

A preferred adaptation of the invention involves mounting the adjustable linkage at an angle to the trunk axle in a direction away from the associated platform end. This can be done, for example, by securing the end of the linkage remote from the blade holder to the truck mounting plate at the end adjacent the compression element.

Here again, adjustment of the screw elements of the linkages permits a selection of a desired cant angle when the trucks are in the rest position. Now, however, when weight is applied to one side of the platform during use, the earlier described rotary and tilting movement of the axle housing causes the cant angle to increase in proportion to the weight applied on both front and rear blades at the side to which weight is applied. This increase in cant or tilt of the blades causes the blade edges to dig increasingly into the ice as the sharpness of a turn is increased by added weight at the platform edge.

While this is happening the cant of the blades at the opposite side of the platform will be reduced, or even reversed, because here the linkages are pulling on the blade mounting extension, instead of pushing as on the weighted side. This is of advantage, particularly when negotiating sharp turns, because, although ice engagement will be concentrated in the blades aligned with the platform edge to which weight is being applied, the opposed blades will have enhanced ice gripping as the cant angle is thus reversed.

This adaptation of the invention permits the user great versatility in providing the optimum blade cant for varied ice conditions, and varied intended uses of the ice skateboard. If high speed and limited maneuverability are desired, the original cant might be as low as 5° to 7.5°; whereas when slower speed but high maneuverability are desired, the initial cant might be in the range of 7.5° to 20°. Regardless of the original setting the degree of cant will be progressively increased as weight is applied to a side of the platform.

Within the ranges above mentioned the general rule in adjusting to different ice conditions is to favor a lower initial cant if the ice is soft and slushy, and a higher initial cant if the ice is hard and glassy.

In the final analysis, however, the user must develop a "feel" concerning the adjustments to make because his own weight, and skateboarding technique will influence responses to any setting.

In the simpler adaptation of the invention employing a blade fixedly mounted to provide a predetermined cant, the cant angle should preferably be in the range of about 7.5° to 30°, with an optimum general purpose angle being about 20°. It is contemplated that such blade mountings with blades at a preset cant angle may be offered in several different and popular cant angles such as 7.5° when maximum speed is desired, and 30° when maximum maneuverability is desired.

For most adaptations of the present invention for use by mature youths and adults, the skate blades should be approximately 6" long and have a very slight convex curvature in the longitudinal direction, and a marked concave curvature in the transverse direction providing two sharpened edges along the skate blade. In junior sized ice skateboards the blade length could be reduced to 5" or even 4". On the other hand, in ice skateboards intended for speed use, where a prime objective is stability with steering control, it may be desirable to extend the blade length to 7" or even 8", and to minimize the convex curvature of the blade edge.

It can also be desirable to provide a slight upward curvature to the ends of the lower surface of the blade mounting member to assist in riding over patches of snow that may be encountered on the ice.

Novel features of the ice skateboard with canted blades in accordance with the present invention will be more fully understood from a consideration of the following description, having reference to the accompanying drawings in which various parts of the device are identified by suitable reference characters in several views, and in which.

Figure 1:
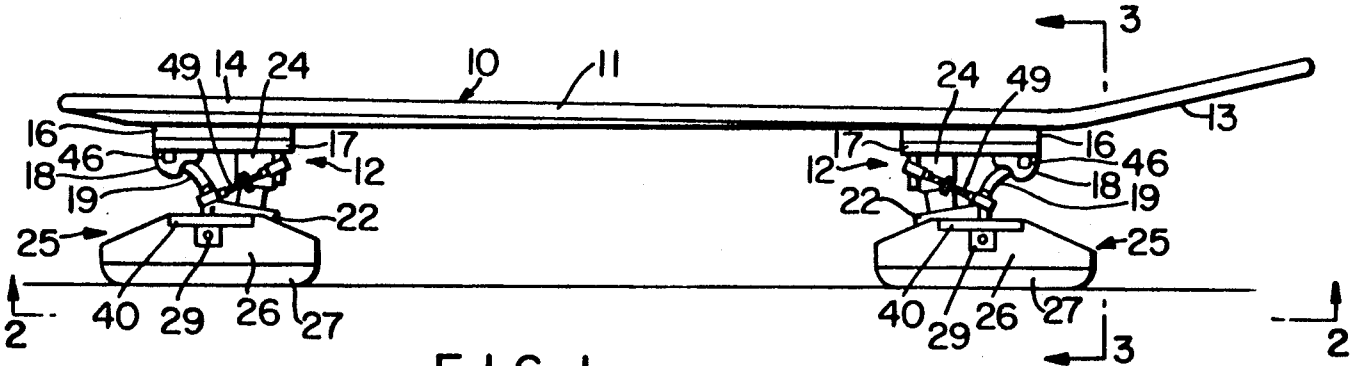
FIG. 1 is a side elevation view of an ice skateboard incorporating a preferred adaptation of the canted blade construction.

Novel features of the present invention are intended to be utilized with conventional skateboard and truck assemblages, of which many variations are currently available. For purpose of illustration I have shown in FIGS. 1 to 3 a skateboard and truck assemblage 10 comprising a platform 11, to which are mounted front and rear trucks 12 of identical structure, but oriented in reverse directions.

As shown in the drawing, the rear end 13 of the platform 11 is elevated in the conventional way to permit maneuvering of the skateboard, and the front portion 14 preferably incorporates slightly lifed side edges to enhance stability of foot engagement with the platform and to accentuate steering forces applied by selective foot placement along the side edges.

Figure 3:
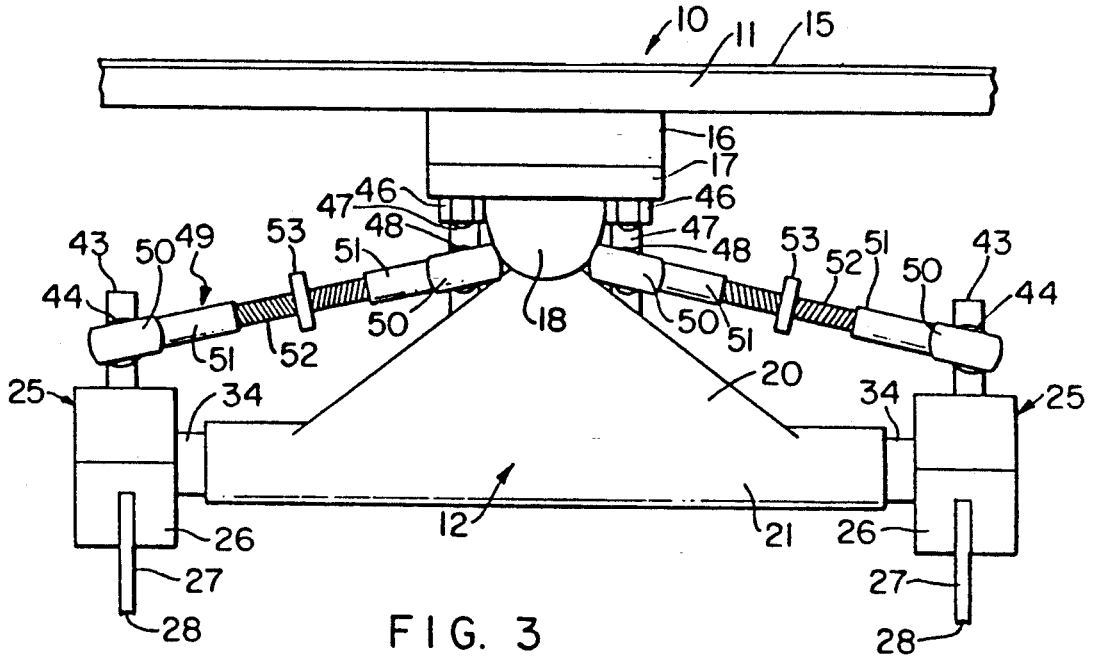
FIG. 3 is an enlarged elevation view of the rear truck and blade assemblage taken substantially on the line 3—3 of FIG. 1.
Figure 4:
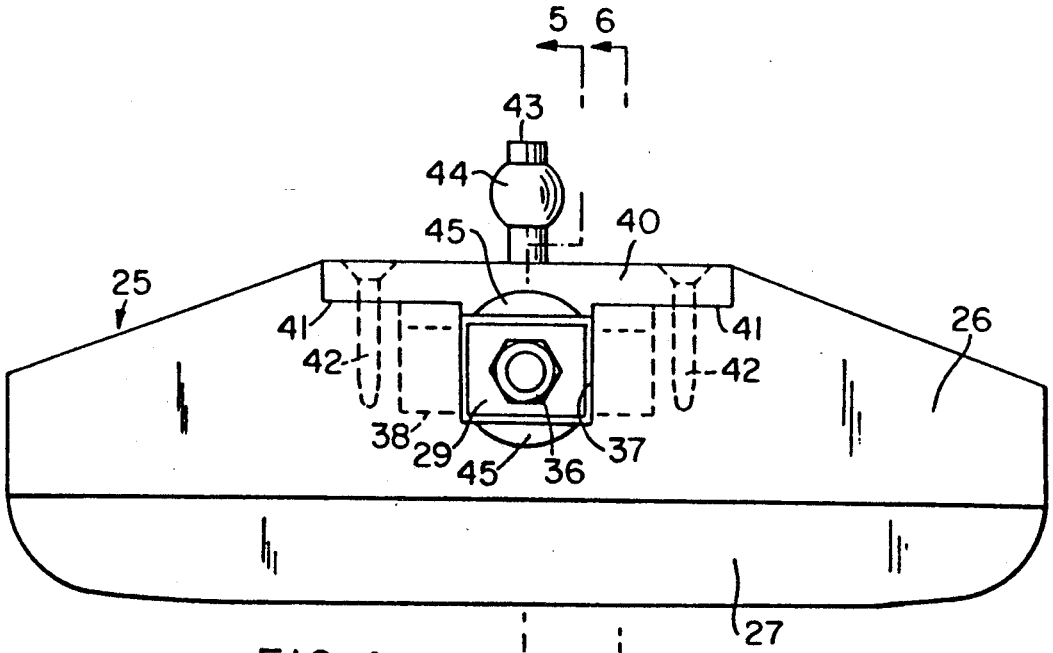
FIG. 4 is an enlarged side view of the blade holder subassembly as shown in FIGS. 1 to 3, and as attached to a truck axle.

As shown in FIG. 3, the platform 11 is preferably provided with a thin layer 15 of natural or synthetic rubber, preferably having a pebbled or otherwise roughened surface contour.

In order to visualize the size of the illustrated device which is drawn essentially to scale, the platform 11 is 30" long and 10½ wide at its widest portion. The platform 11 is suitably supported approximately 4" above the ice surface, and adjustment in this dimension can be achieved by mounting an appropriate spacer block 16 between the platform 11 and the truck assemblage 12.

The truck assemblage comprises a mounting plate 17 of slightly elongated rectangular configuration, having at one end a ball socket 18 for receiving the offset ball end 19 on a web 20 protruding from an axle housing 21 which is normally disposed transversely of the skateboard.

On the other side of the axle housing 21 and substantially perpendicular to the web 20 is a generally triangular protruding member 22 having a central aperture receiving the bolt 23 of a tensioning mechanism supported by housing 24 at the opposite end of mounting plate 17.

Figure 2:
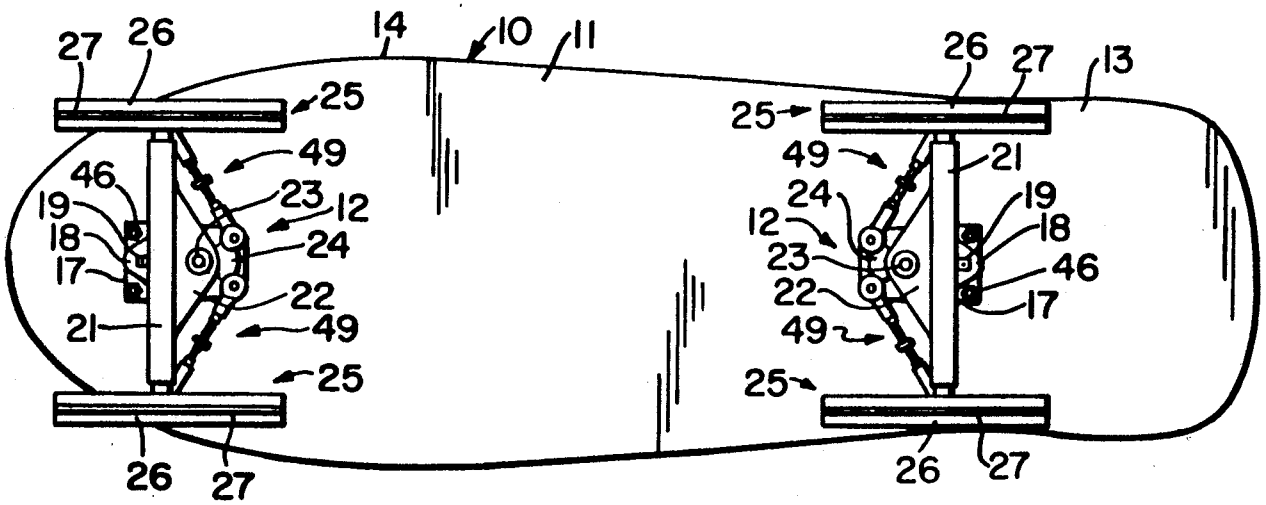
FIG. 2 is a plan view of the ice skateboard assemblage shown in FIG. 1 looking in the direction of the arrows 2—2.

As seen in FIGS. 1 and 2 the angular orientation of the offset ball 19 and the bolt engagement 23 of the tensioning mechanism provides an axis of rotation controlling movements of the axle housing 21 as weight is shifted from side to side on the platform 11. This movement involves slight rotation of the axle housing ends aligned with the applied pressure both towards each other and towards the platform 11.

This combined tilting and rotational movement is what provides the steering capability in the skateboard assemblages and the amount of steering response to applied pressure can be readily adjusted by tightening or loosening bolt 23 to increase or decrease compression of a resilient component of the tensioning mechanism.

At opposed ends of each axle housing 21 are mounted blade holder subassemblages 25, as illustrated in greater detail in FIGS. 4 to 7. Each such subassemblage comprises a body portion 26, suitably fashioned from molded plastic material and supporting centrally of its lower edge a skate blade 27 preferably having a very slightly convex curvature longitudinally of its lower edge, and a concave curvature transversely of said edge, as seen at 25 in FIGS. 5 and 6.

Figure 6:
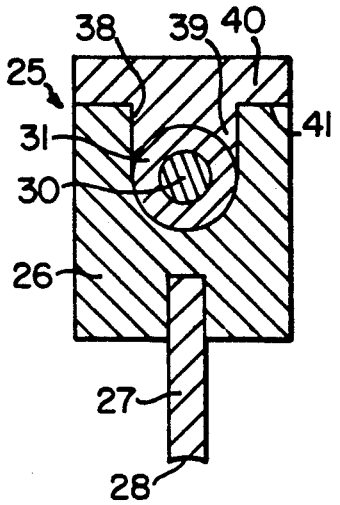
FIG. 6 is a section view substantially on the line 6—6 of FIG. 4.
Figure 7:
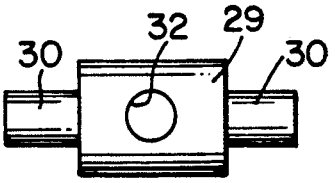
FIG. 7 is a side elevation view of the cylindrical element of FIGS. 4 to 6, as detached from the assemblage.

Supported centrally on the body portion 26 is a longitudinally extending cylindrical member 29 having protruding ends 30 of reduced diameter adapted to be engaged by bearing bushings 31, as seen in FIG. 6. The cylindrical member 29 has a transaxial cylindrical passage 32 for closely but rotatably receiving threaded axle 33 protruding from the axle housing 21. The subassemblage 25 is positioned on the axle 33 by a spacing bushing 34 between the axle housing 21 and the cylindrical member 29 and a washer 35 and nut 36 outwardly of the cylindrical member 29.

To receive the cylindrical member 29 and bearing bushing 31, the body member 26 is provided with a deep central cut-out 37 registering with reduced cutouts 38 to closely engage and position the bearing bushings 31 which are clamped in position by contoured protruding portions 39 on a top plate 40 interfitting with an upper recess 41 in the body member 26. When the cylindrical member 29 and bearing bushings 31 are properly positioned, the top plate 40 is secured to the body member 26 by screws or other fasteners 42.

Figure 5:
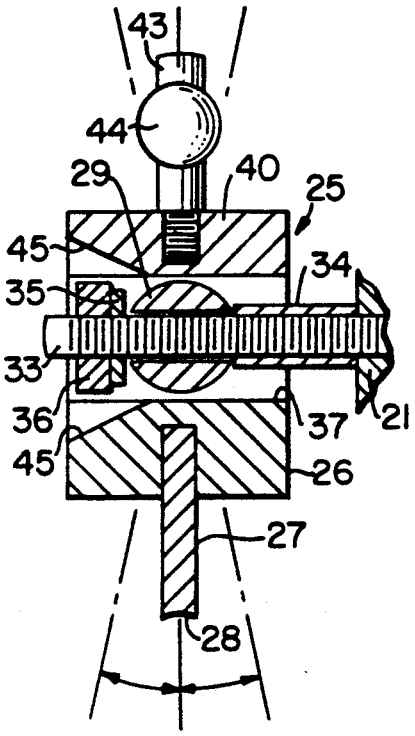
FIG. 5 is a sectional view substantially on the broken line 5—5 of FIG. 4.

Secured centrally on the top plate 40 is an upwardly extended cylindrical member 43 having an enlargement 44 of sperical curvature forming part of the ball-joint linkages later to be described. As transverse force is applied to the sperical enlargement, as shown in FIG. 5, it causes rotation of the body member 26, and the skate blade 27 by reason of the rotation of the cylindrical extensions 30 in the bearing bushings 31. These bushings should therefore be fashioned from bearing metal; and it would even be appropriate to employ roller bearings or ball bearings to assure freedom of rotation in the manner described.

It will also be noted that appropriate cut-outs 45 are provided in the body member 26, and top plate 40 to provide clearance for the nut 36 as body member 26 is thus being rotated.

The mounting plate 17 of the truck assemblage is secured to the platform 10 by bolts 46 at the four corners of the mounting plate. In the modification shown in FIGS. 1 to 3, two of these bolts adjacent the tensioning mechanism housing 24 are replaced by special bolts having a cylindrical extension 47 and enlargement 48 of spherical contour similar to the previously described cylindrical member 43 and enlargement 44.

Actually the cylindrical members 43, 47 with spherical enlargements, 44, 48, are parts of a pre-assembled ball-joint linkage 49 comprising a pair of ball sockets 50 secured to the spherical enlargements 44, 48, and each having tubular extensions 51 receiving a reverse threaded screw element 52 suitably having a central radially expanded member 53 facilitating rotary movement of the screw element 51.

The ball-joint linkage 49 thus joining the fixed sperical extionsion 48 and the movable spherical extension 44, provides the means for controlling desired rotational adjustment of the blade holder 26 and the cant in the blade 27.

As clearly shown in FIG. 2 of the drawing, the ball joint linkage 49 is oriented at a substantial angle to the axle housing 21 and in the direction of the opposed axle housing. By reason of this angularity, the preset angularity of the blade holder 26 and cant of the blade 27 is constantly modified by the shifting of weight in operation and use of the ice skateboard. As weight is added to one side of the skateboard, the movement imparted to the axle housing 21 operates through the linkage 49 to rotate the blade housing 26 in a manner to increase the cant of the blade, and the degree of increase in the cant of the blade will be proportional to the increase in axle housing movement as weight or force is applied to the skateboard edge.

The amount of such movement in response to the weight or force applied can, however, be substantially varied by adjustment of the compression mechanism 24. As the bolt 23 is tightened, the variation in blade cant can be limited, whereas if the operator desires greater maneuverability and the ability to negotiate sharp turns, the bolt 23 should be considerably relaxed.

Figure 8:
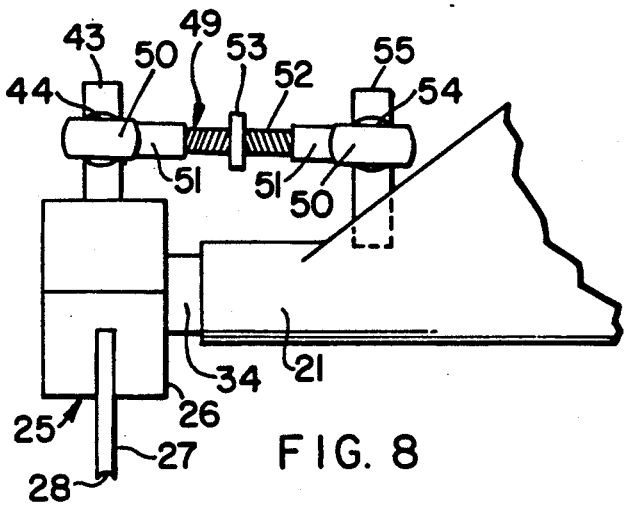
FIG. 8 is a fragmentary view of a portion of the structure shown in FIG. 3 illustrating a modification.

Another adaptation of the preset invention as illustrated in FIG. 8 permits adjustment of the cant of the blade without any variation in the adjusted cant by reason of weight shifting on the platform 11 during use of the skateboard. In this adaptation the ball-joint linkage 49 has one ball socket 50 secured to the enlargement 44 on cylindrical member 43 and the other socket 50 secured to the spherical enlargement 54 on a vertically oriented cylindrical member 55 secured, as by welding, to the axle housing 21. With this arrangement, rotation of the reversed threaded screw element 51 to lengthen the linkage 59 will increase the cant of the blade 27, but because the linkage 49 is aligned with the axis of axle housing 21, movement of the axle housing due to varied pressures on platform 11 does not alter the preset blade cant.

Figure 10:
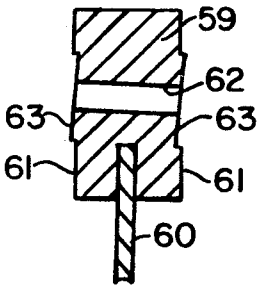
FIG. 10 is a view similar to FIG. 9 illustrating a modified approach.
Figure 9:
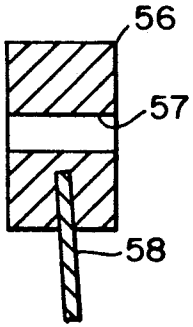
FIG. 9 is a sectional view of the axle engaging portion of a blade holder, illustrating one way to provide a preset cant to the blade.

As shown in FIGS. 9 and 10, the simplest adaptation of the invention avoids the use of any adjustable linkage 49 as previously described, and accomplishes a desired preset blade cant by the structure of the blade holder and blade assemblage. As shown in FIG. 9, a blade holder 56, having a cylindrical passage 57 disposed perpendicularly to the sides thereof for closely and pivotably engaging a threaded axle 33, as previously described, is shown as supporting a blade 58 which is disposed at a desired cant angle with respect to the blade holder 56.

In the slightly modified approach as shown in FIG. 10, blade holder 59 which supports a blade 60 in alignment with its vertical sides 61, includes a transverse cylindrical passage 62 which is disposed at an angle to said sides. Surrounding the passage 62, the sides 61 are deformed to provide bearing surface 63 disposed perpendicularly to the axis of the passage 62. In this adaptation it will be apparent that the desired blade cant is controlled by the selected angularity of the passage 62 and associated bearing surfaces 63.

Figure 11:
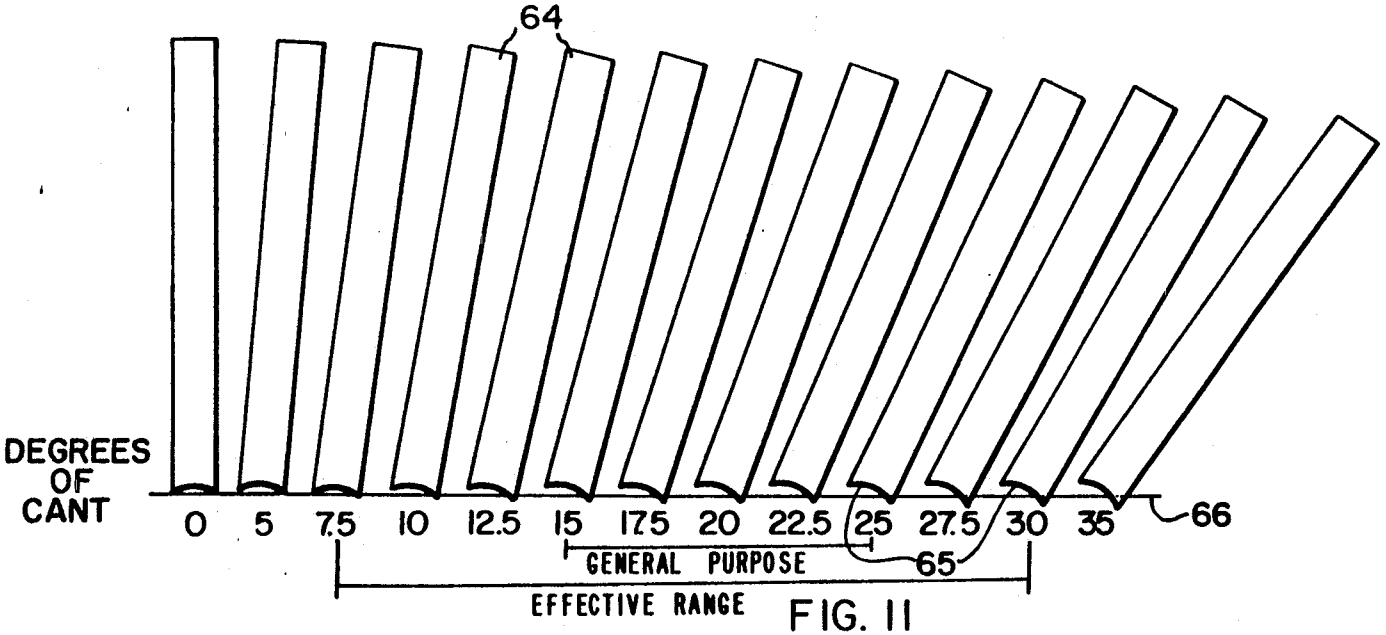
FIG. 11 is a composite view permitting visualization of the changes in ice engagement as the cant angle of the blade is varied.

FIG. 11 is a composite showing a number of skate blades 64 with concave lower edges 65 oriented at different cant angles as indicated in association with an ice surface 66. As will be apparent, the ice penetration by the inclined side of the concave blade edge progressively increases as the cant angle is increased.

For general purpose use of a simple adaptation of the invention as described in connection with FIGS. 9 and 10, the preset blade cant might appropriately be about 15 degrees, permitting in use cant variations between 15 and 20 degrees assuming a moderate tensioning of bolt 23 of the truck assemblage. The change in cant angle during use can, however, be more restricted by tensioning bolt 23, and can be somewhat extended by relaxing of the bolt 23. Users of the ice skateboard will readily get the "feel" of how to adjust bolt 23 for best performance under different (hard or relatively soft) ice conditions, and for the type of performance desired, i.e. maximum speed or maximum maneuverability. As a general rule, maneuverability will be progressively increased as tension on the bolt 23 is relaxed.

The type of cant adjustment illustrated in FIG. 8 enables the user to better adapt the preset cant to differing ice conditions. Thus, when faced with soft ice conditions, he might select a preset cant adjustment somewhere in the range of 7.5 degrees to 15 degrees, and if confronted with very hard ice conditions, he might preset the cant at something a bit higher than 15 degrees.

With the preferred adaptation of the invention as discussed in connection with FIGS. 1 to 7, the variation in cant angle during use by reason of the angularly disposed adjustable linkages 49 provides great versatility to the user in adjusting the linkages 49 and tensioning of the bolts 23, for obtaining optimum performance under differing ice conditions and differing intended uses, i.e. whether desiring primarily stability at high speed, or maximum maneuverability at lower speeds. Here again, the user will readily develop a "feel" for the type of adjustment in the linkages 49 which will be best for a particular intended use of the ice skateboard.

Various changes and modifications in the ice skateboard as herein disclosed may occur to those skilled in the art, and to the extent that such changes and modifications are embraced by the appended claims, it is to be understood that they constitute part of the present invention.

I claim:

1. In an ice skateboard comprising an elongated platform having secured to front and rear portions of an underside skateboard trucks, with transverse axles supported by a structure facilitating slight controllable swinging movement of the axle in response to the shifting of weight on the platform, wherein each of the front and rear axles rotatably supports at opposed ends thereof elongated skate blade mounting units in a manner to be parallel to the center line of the platform, and each of the mounting units bearing a skate blade protruding in a direction away from the platform, the exposed edge of each blade having a front to rear contour of slightly convex curvature and a transverse contour of markedly concave curvature providing closely spaced ice gripping edges, the improvement that comprises incorporating in the blade mounting units structural features imparting to the blades a cant of at least 5° to thereby convergently orient the exposed edges of the mounted blades, wherein the structural features of said blade mounting units provide for rotation of said mounting units, both with respect to the truck axles, and with respect to the longitudinal dimensions of said mounting units, and upwardly protruding elements at the top of said mounting units in alignment of the truck axles are joined by adjustable linkages to spaced portions of said trucks, and longitudinal adjustment of said linkages providing controlled rotation of said mounting units with respect to their longitudinal dimensions to thereby controllably vary the cant angles of said blades.

2. An improved ice skateboard as defined in claim 1 wherein rotation of the blade mounting units, with respect to their longitudinal dimensions is provided by cylindrical members, extending longitudinally of and rotatable in said blade mounting units, and said cylindrical members having transverse axle receiving passages.

3. An improved ice skateboard as defined in claim 2 wherein said cylindrical members have enlarged central portions with reduced diameter extensions rotatably mounted in bearing sleeves, and said bearing sleeves being fixedly mounted in said blade mounting units.

4. An improved ice skateboard as defined in claim 3 wherein clamping engagement of said bearing sleeves is provided by protruding portions of central top plates detachably secured to said blade mounting units.

5. An improved ice skateboard as defined in claim 4 wherein said upwardly protruding means are carried by said detachable top plates.

6. An improved ice skateboard as defined in claim 4 wherein portions of said top plates and blade mounting units adjacent said cylindrical members at portions remote from said trucks have cut out contours providing clearance for axle mounting fasteners as the blade mounting units are rotated with respect to said cylindrical members.

7. An improved ice skateboard as defined in claim 1 wherein said adjustable linkages comprise double ball-joint mountings having tubular, internally threaded extensions engaged by reverse threaded screw elements having central enlargements facilitating rotation thereof.

8. An improved ice skateboard as defined in claim 1 wherein the ends of said adjustable linkages remote from said blade mounting units are secured to said trucks at points to align said linkages parallel to the axles thereof, whereby a preadjusted cant of the skate blades remains constant during use of the skateboard.

9. An improved ice skateboard as defined in claim 1 wherein remote ends of said adjustable linkages are secured to said trucks at points spaced from the truck axles in the direction of the opposed truck, whereby the preadjusted cant angle is increased in the blades aligned with the skateboard edge to which weight is applied, with The increase in cant angle being proportional to the increase in applied weight.

10. An improved ice skateboard as defined in claim 9, wherein the ball-joint mountings at said remote ends of the adjustable linkages carry threaded means cooperating in the securing of the associated truck to said skateboard platform, whereby said adjustable linkages are angularly disposed with respect to both the truck axles and the skateboard platform.

* * * * *